United States Patent [19]

Nangeroni

[11] Patent Number: 4,607,928

[45] Date of Patent: Aug. 26, 1986

[54] PLIANT SHIELD FOR PROTECTING PHOTOGRAPHIC PROCESSING LIQUID FROM AMBIENT ATMOSPHERE

[75] Inventor: Robert J. Nangeroni, No. Easton, Mass.

[73] Assignee: Polaroid Corporation, Cambridge, Mass.

[21] Appl. No.: 740,587

[22] Filed: Jun. 3, 1985

[51] Int. Cl.[4] ..... G03D 5/02; G03D 5/06

[52] U.S. Cl. ..... 354/304; 354/305; 354/317; 354/318

[58] Field of Search ..... 354/303, 304, 305, 317, 354/318, 84, 85, 86, 87; 352/130; 430/497, 498, 499, 208, 207

[56] References Cited

U.S. PATENT DOCUMENTS

| | | | |
|---|---|---|---|
| 3,307,468 | 3/1967 | Briber | 354/318 |
| 3,342,600 | 9/1967 | Downey | 430/208 |
| 4,200,383 | 4/1980 | Bendoni et al. | 354/304 |
| 4,200,384 | 4/1980 | Josephson et al. | 354/304 |
| 4,341,857 | 7/1982 | Aoki | 430/207 |
| 4,357,091 | 11/1982 | Bendoni et al. | 354/304 |
| 4,371,248 | 2/1983 | Sulesky | 354/304 |
| 4,371,249 | 2/1983 | Czumak et al. | 354/304 |
| 4,566,772 | 1/1986 | Sulesky et al. | 354/318 |

*Primary Examiner*—A. A. Mathews

*Attorney, Agent, or Firm*—Alfred E. Corrigan

[57] ABSTRACT

A film processing liquid in a reservoir is covered with a pliant apron or shield which is adapted to substantially conform to the surface of the liquid to prevent the latter from being adversely affected by the ambient atmosphere during the time that the liquid is expelled from a container and is withdrawn from the reservoir.

14 Claims, 4 Drawing Figures

PLIANT SHIELD FOR PROTECTING PHOTOGRAPHIC PROCESSING LIQUID FROM AMBIENT ATMOSPHERE

BACKGROUND OF THE INVENTION

1. Field of the Invention

The invention relates to means for protecting a photographic processing liquid from the adverse effects of the ambient atmosphere during the time interval between its release from a container and its application to a sheet material as a coating.

2. Description of the Prior Art

The present invention relates to the protection of a supply of photographic processing liquid from the oxidizing effects of the atmosphere and from being entrained therewith during the withdrawal of the liquid from a reservoir. U.S. Pat. No. 3,307,468 recognizes the problems associated with the exposure of a processing liquid to the ambient atmosphere and suggests that one solution may be to minimize the volume of air within a processing liquid reservoir during the time that the processing liquid is not being coated onto a length of sheet material. Further, U.S. Pat. No. 4,341,857 recognizes the problem of trapped air affecting image quality because it affects the thickness of a layer of processing liquid covering an emulsion or negative sheet and thus recommends that such trapped air be confined to an area outside of the photograph's image area.

In a preferred embodiment of the invention a shield in the form of an apron or flap is attached to a single use, disposable container of processing liquid adjacent to a rupturable end thereof. The container may be a part of a disposable processing kit which is adapted for use in a film processor of the type shown in U.S. Pat. Nos. 4,371,249, 4,371,248, and 4,357,091. Generally, the provision of a rupturable container of processing liquid with an apron or tab is well known, as evidenced by U.S. Pat. Nos. 4,200,384, 4,200,383, 3,342,600, as well as the aformentioned '091 patent. However, none of these patents teaches or suggests that such aprons or tabs may be constructed such that they will substantially conform to the changing configuration of the surface of a supply of processing liquid as it is being directed into and removed from a reservoir, thus minimizing oxidization of the processing liquid and its entrainment with the ambient atmosphere.

SUMMARY OF THE INVENTION

The instant invention relates to means for minimizing the oxidization of a processing liquid by the ambient atmosphere and/or the entrainment of the atmosphere into the processing liquid. More specifically, the means for carrying out the above takes the form of a shield having the configuration of an apron or tab which extends from a rupturable end of a single use, disposable container of processing liquid. The processing liquid contains a component, e.g., triaminophenol, which is capable of increasing the speed of an exposed photographic film strip to be developed thereby while still providing a smooth, vis-a-vis grainy, appearance. However, triaminophenol is highly oxidizable and as such must be protected from the adverse affects of the ambient atmosphere lest it causes streaks in the processed film. Further, entrainment of the atmosphere into the processing liquid must also be minimized to reduce its adverse effects, such as spots, upon the processed film. Accordingly, the shield is formed from a pliant film, e.g., saran (0.2 mils thick), polyester (0.92 mils thick), etc., which is compatible with the processing liquid. The shield is located adjacent to the rupturable end of the container such that it will overlie the processing liquid as it is being expelled from its container into a reservoir. The free end of the shield extends into the reservoir and substantially conforms to the surface of the processing liquid as its level within the reservoir initially increases. The bottom of the reservoir includes an egress having a nozzle therein which is adapted to apply a coating or layer of the processing liquid to a gelatin coated surface of a strip sheet prior to the latter being laminated to the emulsion side of an exposed strip of photographic film in order to initiate the formation of a visible image within the exposed film. In an experiment wherein a shield was not used to protect the surface of the processing liquid in the reservoir, it was observed that as the processing liquid is being applied to the strip sheet, a rotational flow about a horizontal axis which is transverse to the direction of movement of the strip sheet past the nozzle develops in the processing liquid in the reservoir. It is believed that this rotational flow assists in entraining or mixing the ambient atmosphere with the processing liquid thus adversely affecting the developed image in the photographic film. However, it has also been observed that this rotational flow is reduced and the entrainment problem minimized by constructing and forming the shield such that it substantially conforms to the surface of the liquid in the reservoir thereby minimizing contact of said surface with the ambient atmosphere.

The shield is also provided with a plurality of small openings in the form of apertures or slits which function to permit the escape of any air which may have been trapped under the shield during the initial surge of the processing liquid from the container. Although such openings increase the area of the surface of the processing liquid which is exposed to the ambient atmosphere, such increased exposure does not oxidize the processing liquid to the extent where its affect upon the photographic image in the film is substantially material.

An object of the invention is to provide a means for protecting a photographic processing liquid from the adverse affects of the ambient atmosphere during its passage from a sealed container to a coating nozzle.

Another object of the invention is to provide a single use, disposable, container with an apron which will shield a major surface of a supply of photographic processing liquid from the atmosphere as it is expressed from a rupturable end of the container.

Still another object of the invention is to provide a shield for protecting a photographic processing liquid from being adversely affected by the ambient atmosphere while also allowing the escape of air which may be trapped between the shield and the processing liquid.

Other objects of the invention will in part be obvious and will in part appear hereinafter.

The invention accordingly comprises the construction, combination of elements and arrangement of parts which are exemplified in the following detailed disclosure, and the scope of the application of which will be indicated in the claims.

BRIEF DESCRIPTION OF THE DRAWINGS

For a fuller understanding of the nature and objects of the invention, reference should be had to the following detailed description taken in connection with the accompanying drawings wherein.

DETAILED DESCRIPTION OF THE INVENTION

Figure 1:
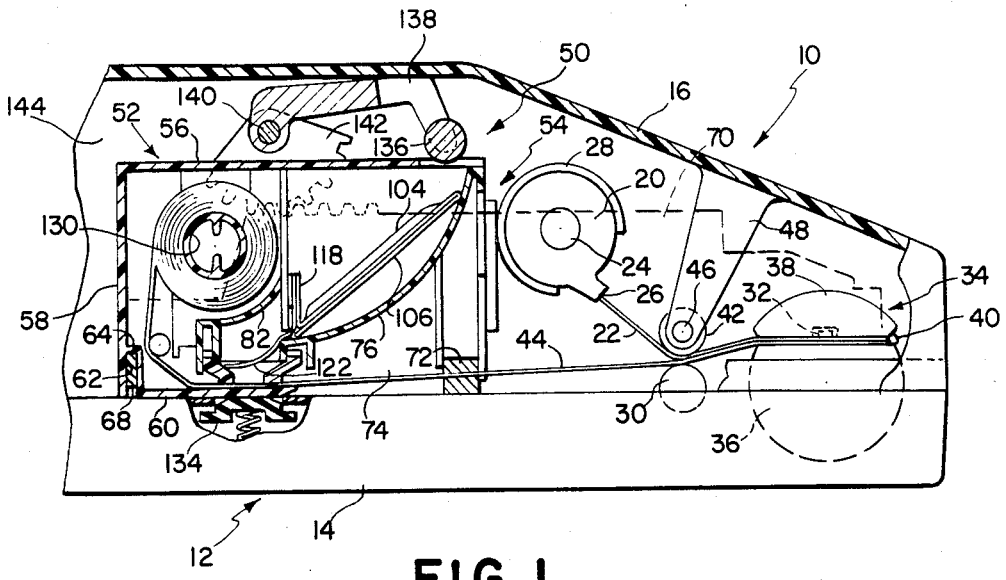
FIG. 1 is a side elevational view, partly in section, of a major portion of a photographic film processor with the instant invention being located therein.
Figure 2:
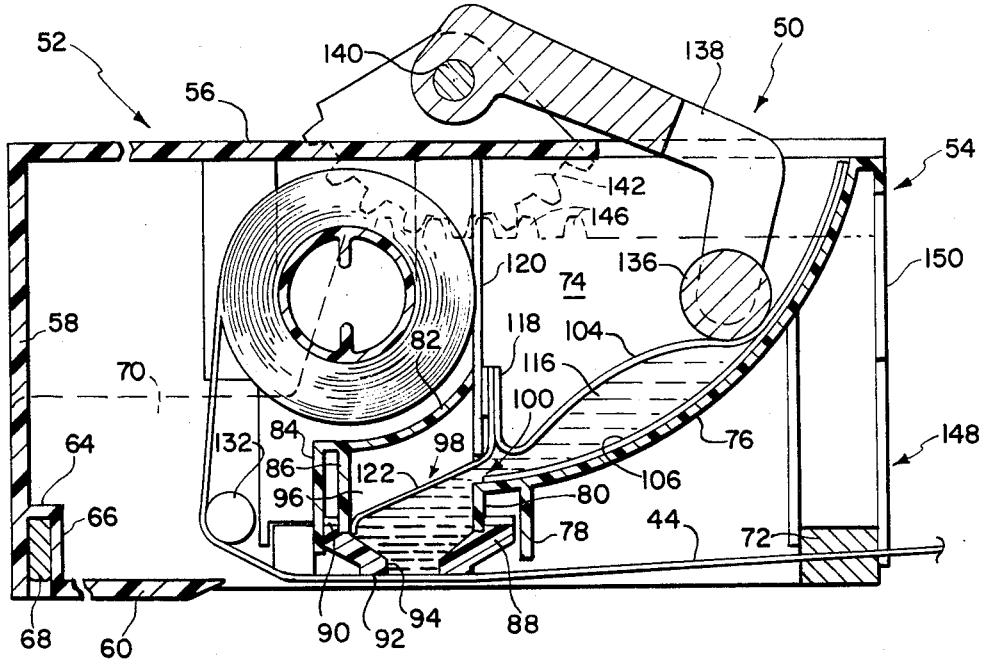
FIG. 2 is an enlarged side elevational view of a portion of the processor shown in FIG. 1 and its relation to a processing kit.
Figure 3:
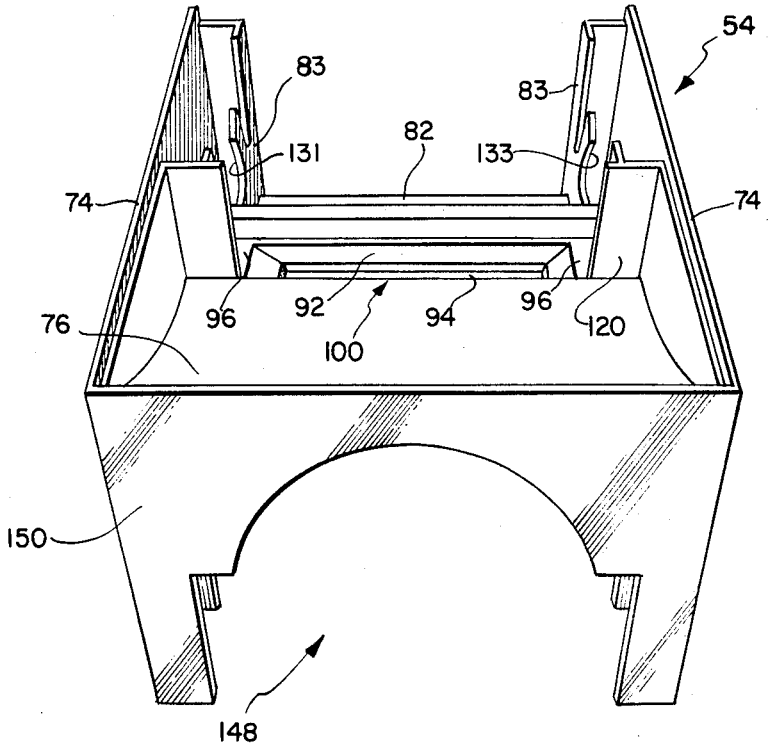
FIG. 3 is an enlarged perspective view of a housing section of the processing kit.
Figure 4:
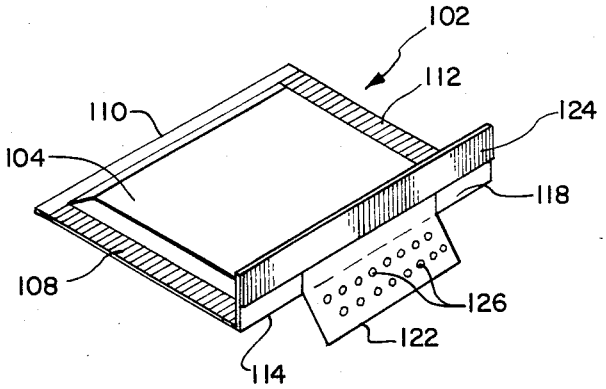
FIG. 4 is a perspective view of a preferred form of the instant invention.

Reference is now made to the drawings, and in particular to FIG. 1, wherein is shown a photographic film processor 10 in which the present invention may be used. The film processor 10, which is described in detail in U.S. Pat. No. 4,371,248, includes a light-tight housing 12 comprised of a housing section 14 and a loading door 16 which is pivotally coupled to the left end of the housing section 14, as viewed in FIG. 1.

Mounted within the film processor 10 is a means for supporting a film cassette 20 containing a roll of photographically exposed, self-developing type transparency film 22. The film 22 is wound upon a rotatable film spool 24 with one end of the film 22 being secured to the film spool 24 and its opposite end being adapted to extend to the exterior of the film cassette 20 via a film withdrawal slot 26. These supporting means include a semicircular flange 28 which is adapted to receive the cylindrically configured film cassette 20.

The leader or free end of the strip of film 22 is adapted to be placed over a roller 30, the journals of which are rotatably supported by a pair of brackets, not shown, which extend upwardly from the housing section 14; and then it is attached to a post 32 on a take-up drum 34. The take-up drum 34 is rotatably supported within a well or recess in the housing section 14 and is comprised of first and second sections 36 and 38 which are pivotally connected to each other by a hinge 40. The roller 30 is adapted to cooperate with a roller 42 to laminate the film 22 to a length of flexible sheet material or strip sheet 44 prior to wrapping the laminate upon the take-up drum 34, as will be more fully described hereinafter. The journals 46 (only one shown) of the roller 42 are rotatably supported by a pair of arms 48 (only one being shown) which extend downwardly from the loading door 16.

The film processor 10 is adapted to receive a film processing kit 50 which contains the necessary elements to process the entire length of the strip of film 22. The film processing kit 50, which is more fully described in the '249 patent, includes a housing consisting of a first section 52 and second section 54 which is constructed to telescopically receive the first section 52. The first section 52 includes a top wall 56, an end wall 58, and a bottom wall 60. The end wall 58 includes an integrally formed passageway 62 formed by horizontal and vertical flanges 64 and 66, respectively. During loading of the kit 50 into the processor 10, the passageway 62 is adapted to receive an arm 68 which extends inwardly from a link 70, while a pair of laterally spaced cams 72 (only one being shown) enter apertures in the side walls 74 of the second section 54 to prevent its movement during movement of the first section 52.

The second section 54 also includes an arcuate wall 76 which extends between the side walls 74 and terminates at its lower end in a pair of longitudinally spaced vertical walls 78 and 80. A second, shorter, arcuate wall 82 extends between another pair of side walls 83 and terminates at its lower end in still another pair of longitudinally spaced walls 84 and 86. The spaces between the walls 78, 80 and the walls 84 and 86 are adapted to receive a pair of laterally extending flanges 88 and 90, respectively, of a nozzle 92 having an opening 94 therein. The vertical walls 80 and 86 together with a pair of side walls 96 define a processing liquid reservoir 98 having an ingress 100 and an egress in which the nozzle 92 is located.

The arcuate wall 76 is adapted to support a generally rectangular, single use, disposable container 102 having first and second walls 104 and 106 arranged in superposition with portions thereof cooperating with each other to define a plurality of sides 108, 110 112, including a rupturable side 114, of a cavity for containing a supply of photographic processing liquid 116. The first wall 104 includes means in the form of an upwardly bent extension 118 which cooperates with a vertical wall 120 of the second section 54 of the kit 50 to properly locate the rupturable side 114 of the container 102 adjacent to the ingress 100 of the reservoir 98. A shield 122, formed from any suitable pliant material such as saran or polyester, is secured to the extension 118 by any suitable means such as a piece of adhesive tape 124. The shield 122 includes a plurality of apertures 126 therein which function to permit the escape of any air which may be trapped betwen the surface of the processing liquid and the shield 122 during passage of the processing liquid 116 from the container 102 to the reservoir 98.

Also mounted within the processing kit 50 is a roller 130 to which one end of the strip sheet 44 is secured. The journals of the roller 130 are rotatably supported within U-shaped openings 131 and 133 in the walls 83. As the strip sheet 44 leaves the roller 130 it runs behind an idler roller 132, beneath and in contact with the nozzle 92, over the roller 30, and then to the take-up drum 34 where its free end is secured to the post 32. As best seen in FIG. 1, a spring biased pressure plate 134 mounted in the housing section 14 maintains the strip sheet 44 in firm engagement with the nozzle 92.

The container 102 of processing liquid 116 is adapted to be ruptured by a roller 136. The opposite ends of the roller 136 are rotatably supported in the free ends of a pair (only one shown) of L-shaped arms 138. The other ends of the arms 138 are pivotally coupled to opposite side walls of the cover 16 by a pin 140. Also mounted on the pin 140 is a sector gear 142 which is in mesh with gear teeth 144 on the link 70 when the cover 16 is in its closed position. Rotation of the roller 136 and the sector gear 142 about the axis of the pin 140 is in response to the manual actuation of a lever (not shown) which is connected to one end of the pin 140 and is located on the exterior side of a side wall 144 of the cover 16.

In operating the processor 10, the loading door 16 is pivoted in a counterclockwise direction so as to enable a film cassette 20 and processing kit 50 to be positioned as shown in FIG. 1 with the leaders of the exposed film 22 and the strip sheet 44 attached to the take-up drum 34. The loading door 16 is then closed thus rendering the interior of the processor 10 lighttight, while also placing the sector gear 142 in mesh with the gear teeth 146. The aformentioned lever (not shown) attached to the pin 140 is then rotated in a clockwise direction, as viewed in FIG. 1, thus sequentially causing the sector gear 142, and then (through a lost motion connection not shown) the arms 138, to rotate in the same direction. Such rotation is effective to first drive the link 70 to the left while the arm 68 causes the first section 52 of the processing kit 50 to move away from the second section 54. Shortly after the top wall 56 of the first section 52 has moved to left, the lost motion connection connects the rotation of the aforementioned lever to the arms 138 and thus to the roller 136. As the roller 136 pivots in a clockwise direction about the axis of the pin 140 it engages the wall 104 of the processing liquid container 102 thus increasing the hydraulic pressure of the processing liquid to a point where it ruptures the side 114. Continued clockwise rotation of the arms 138 causes the roller 136 to express the processing liquid 116 from the ruptured side 114 of the container 102 and force it into the reservoir 98. During the initial surge of the processing liquid 116 from the container 102, the advancing wave of processing liquid engages the pliant shield 122, which is originally located within the reservoir 98 as shown in FIG. 1, and gradually lifts it as the level of the processing liquid 116 rises in the reservoir. During this time, any air which may have been trapped between the shield 122 and the surface of the processing liquid 116 is allowed to escape via the apertures 126, apparently because of the greater pressure of the trapped air, vis-a-vis, the ambient atmosphere. After the roller 136 has substantially emptied the container 102, a hand crank (not shown) is driven in a manner which rotates the take-up drum 34 in a clockwise direction. Such rotation is effective to withdraw the film 22 from its cassette 20 and the strip sheet 44 from the processing kit 50 while simultaneously winding them in superposition upon the take-up drum 34. As the strip sheet 44 moves past the nozzle 92 a coating of the processing liquid 116 is applied to the gelatin coated side thereof. The newly coated strip sheet 44 then leaves the processing kit 50 via a passageway 148 in an end wall 150 of the second section 54 and is laminated to the exposed film 22 as the two pass between the rollers 30 and 42. The resultant laminate is then wound upon the take-up drum 34.

As the level of the processing liquid 116 in the reservoir 98 drops during the coating of the strip sheet 44, the pliant shield 122 continues to conform with and stay in substantial engagement with the surface of the processing liquid thus minimizing the aforementioned adverse effects of oxidation and/or air entrainment.

When the entire length of the exposed film 22 has been unwound from its spool 24, the increase in tension in the film due to its trailing end still being firmly attached to the spool 24 is transferred to the take-up drum 34 and thus to its crank, thereby causing the operator to stop cranking. The convolutions of laminate upon the take-up drum 34 are then allowed to remain in place while the processing liquid 116 imbibes the film 22. After the latent images in the film 22 have been substantially developed, a period of approximately one minute, the output of the manual crank (not shown) is transferred from the take-up drum 34 to the film spool 24 and the strip sheet roller 130. Rotation of the crank now drives the spool 24 and roller 130 in clockwise directions thus withdrawing the laminate of the film 22 and strip sheet 44 from the now substantially free wheeling take-up drum 34. As the laminate leaves the bite of the rollers 30 and 42, the film 22 takes a different path of movement than the strip sheet 44 thus causing the two to be separated or stripped from each other. Thus, only the processed length of film 22 is returned to its cassette 20 while the used strip sheet 44, which now carries the emulsion layer of the film 22, is wound upon the roller 130. The processor 10 may then be opened, the processing kit removed and safely discarded, and the film cassette 20 removed for subsequent cutting and mounting of the processed individual visible images in the film strip.

Since certain changes may be made in the above described invention without departing from the scope thereof, it is intended that all matter contained in the above description or shown in the accompanying drawings shall be interpreted as illustrative and not in a limiting sense.

For example, although the preferred embodiment of the invention describes the pliant shield as extending from the discharge end of the processing liquid container, it, the pliant shield, could alternatively be connected to a wall of the processing kit at a location where it would overlie the discharge end of the liquid container.

What is claimed is:

1. Apparatus for use in directing a flow of processing liquid to a coating nozzle during a photographic film processing operation, said apparatus comprising;

a housing;

means for defining a reservoir within said housing, said reservoir including an ingress and an egress having a coating nozzle therein;

a container of processing liquid having an end through which the processing liquid is adapted to be expelled;

means for supporting said container within said housing with said end of said container positioned to direct the processing liquid into said reservoir via said ingress; and means for shielding the surface of the processing liquid from the ambient atmosphere as the processing liquid moves into and out of said reservoir, said shielding means being formed from a pliant material which substantially conforms to the surface of the processing liquid and follows the same as the level of the processing liquid within said reservoir changes.

2. Apparatus as defined in claim 1 wherein said shielding means is formed as a film.

3. Apparatus as defined in claim 2 wherein said film is formed from a polyester.

4. Apparatus as defined in claim 2 wherein said film is formed from saran and has a thickness of approximately two ten thousands of an inch.

5. Apparatus as defined in claim 2 wherein said film includes means for allowing the escape of air trapped under said film into the ambient atmosphere.

6. Apparatus as defined in claim 5 wherein said escape means includes a plurality of perforations.

7. Apparatus as defined in claim 5 wherein said escape means includes a plurality of slits.

8. Apparatus as defined in claim 2 wherein said film is attached to said container adjacent to said end and extends therefrom toward said reservoir.

9. Apparatus as defined in claim 2 wherein said container further includes means adapted to engage said supporting means for locating said end of said container adjacent to said ingress of said reservoir.

10. Apparatus as defined in claim 9 wherein one end of said film is attached to said locating means.

11. As a new product, a single use, disposable container releasably carrying a photographic processing liquid for use in a photographic process wherein the processing liquid is adapted to be released from a rupturable end of the container in response to the application of a predetermined force to the container which increases the hydraulic pressure within the processing liquid, said container comprising:

first and second walls arranged in superposition with portions thereof defining a plurality of sides, including one rupturable side, of a cavity;

a photographic processing liquid releasably contained within said cavity, said processing liquid being highly susceptible to oxidation by the ambient atmosphere; and means for shielding said processing liquid from the oxidizing effects of the ambient atmosphere as the processing liquid is expressed from said cavity via said one rupturable side upon the application of force to at least one of said first and second walls, said shielding means extending from said one rupturable side in a direction away from said cavity and being formed from a pliant material which conforms to a major surface of the processing liquid being expressed from said cavity.

12. A single use, disposable, container as defined in claim 11 wherein said first wall includes means for properly locating said rupturable side of said cavity adjacent to a processing liquid reservoir in a film processor.

13. A single use, disposable, container as defined in claim 12 further including means for securing one end of said shielding means to said locating means.

14. A single use, disposable, container as defined in claim 11 further including means defining a plurality of openings in said shielding means.

* * * * *